US006318840B1

(12) United States Patent
Sette et al.

(10) Patent No.: US 6,318,840 B1
(45) Date of Patent: Nov. 20, 2001

(54) IN-LINE PRINTER WITH AUTOMATIC POSITIONING MULTIPLE MICROPROCESSOR CONTROLLED PRINT HEADS

(75) Inventors: Paul R. Sette, Branford; Richard A. Sloan, Jr., Southbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/716,979

(22) Filed: Nov. 20, 2000

(51) Int. Cl.[7] ..... B41J 2/145
(52) U.S. Cl. ..... 347/37; 400/82
(58) Field of Search ..... 347/12, 14, 19, 347/37, 101; 400/82, 279, 630, 642, 323, 56

(56) References Cited

U.S. PATENT DOCUMENTS 5,192,141 * 3/1993 Chung et al. ..... 400/56
5,428,375 * 6/1995 Simon et al. ..... 347/12
6,139,206 * 10/2000 Ahn ..... 400/323

* cited by examiner

*Primary Examiner*—Anh T. N. Vo
(74) *Attorney, Agent, or Firm*—Ronald Reichman; Michael E. Melton

(57) ABSTRACT

A method and a printer for printing on a substrate with a plurality of automatic positioning multiple microprocessor controlled print head assemblies, wherein each assembly includes at least one print head and arranged for movement along a rectilinear path transverse to the direction of movement of the substrate feed path. A microprocessor-based controller determines the print position and directs the print head assemblies to print positions by motor control to properly place the print head assemblies over the substrate feed path. An encoder senses the position of a movable fence used to adjust the width of the feed path according to the width of the substrate to determine a dimension which corresponds to a set of pre-determined criteria used to position and control the print heads for printing on the substrate surface.

10 Claims, 5 Drawing Sheets

IN-LINE PRINTER WITH AUTOMATIC POSITIONING MULTIPLE MICROPROCESSOR CONTROLLED PRINT HEADS

CROSS REFERENCE TO RELATED APPLICATIONS

Reference is made to Application Ser. No. 09/716,978, entitled MULTIPLE INLINE PRINT HEAD WITH SERVO DRIVEN MECHANICAL INTERLOCKD PRINT HEAD ASSEMBLIES, assigned to the assignee of this application and filed on even date herewith.

Reference is made to Application Ser. No. 09/716,982, entitled MULTIPLE INLINE PRINT HEAD MANUALLY POSITIONED WITH MECHANICALLY INTERLOCKED PRINT HEAD ASSEMBLIES, assigned to the assignee of this application and filed on even date herewith.

TECHNICAL FIELD

The present invention relates generally to in-line printers and deals more specifically with an in-line printer having automatic positioning multiple microprocessor controlled print heads.

BACKGROUND OF THE INVENTION

In-line configured printers are important because they minimize the length (along the substrate or printing medium) of the print zone, and thereby minimize the overall envelope of the printing machine. Accommodating a longer print zone expands the overall printing machine envelope which is critical to cost, weight, installation space, inventory and shipping. In-line printers, particularly in-line printers for printing indicia, return address, destination address and/or destination barcode together with optional message line and/or destination barcode on a substrate such as a mail piece, use multiple spaced assemblies of print heads to carry out the required printing.

The positioning of the print head assemblies in such in-line printers is typically accomplished by manual movement of the assemblies with respect to one another in those in-line printers that have movable print head assemblies and after such manual location are then locked in a fixed location. The position of the various areas of information to be printed are located relative to one another with variable spacing depending upon the width of the printing medium material, such as, for example, a print stock postal card, an envelope such as a #10 business envelope, a 9"×12" flat mailing envelope or custom-sized envelope, to be printed. In such in-line printers, a first multiple print head assembly is located to print in a fixed print area of the substrate as the substrate passes relative to the print head. The first multiple print head assembly may be aligned and located to print in a fixed print area that, for example, may be in the print area that includes the return address or other indicia information. A second multiple print head assembly is located relative to the first print head assembly and positioned to print in a second print area, which may include, for example, the destination address and/or destination barcode. A third multiple print head assembly is located and positioned relative to the second and first multiple print head assemblies and located to print in a third print area, which may include, for example, a message line or optional barcode. The location of the first, second and third print areas on a mail piece are within predetermined areas of the mail piece and are typically specified by United States Postal Service standards to accommodate mechanized mail processing for each of the differently sized mail pieces. When a user desires to print with an in-line printer on a differently sized substrate or mail piece, the print head assemblies must be repositioned and located and locked in a different position to meet the location print area requirements for the size of the mail piece being printed.

In-line printers such as those described above require operator intervention to relocate and reposition the multiple print heads each and every time a differently sized mail piece is printed. The operation and set-up of such in-line printers is labor intensive and cumbersome and less than satisfactory. In addition, the continual resetting and repositioning of the print head assemblies relative to one another may lead to positional error and requires constant verification that the print head assemblies are positioned and located properly to meet the addressing standards for the given size mail piece.

Accordingly, it would be desirable to provide an in-line printer having multiple print head assemblies that are individually controllable and automatically positionable and movable relative to one another to accommodate different width substrates to print on each of the desired print areas as the substrate and print head assemblies move relative to one another to print in each of the predetermined print areas of a mail piece.

It is an additional object of the present invention to provide an in-line printer that automatically determines the dimension of the mail piece as it is fed into the printer for controlling the print position of the assembly of print heads.

SUMMARY OF THE INVENTION

The present invention substantially obviates, if not entirely eliminates, the disadvantages and shortcomings of in-line printers having multiple spaced-apart print head assemblies that require positioning relative to one another to print in predetermined print areas on a substrate such as a mail piece. The invention accomplishes this by providing an in-line printer having automatic positioning multiple microprocessor controlled print head assemblies to properly cover the width of the substrate.

The in-line printer comprises: means for registering one edge of the substrate; a plurality of automatic, positional print heads assemblies, each assembly including at least one print head; and a microprocessor-based controller for determining a print position for each one of the print heads.

Additionally, the printer comprises: a first moving mechanism capable of moving the substrate towards the print head assemblies along a feed path in a feed direction substantially perpendicular to the width of the substrate; one or more motor controller assemblies for directing each one of the print head assemblies to its associated print position in order to simultaneously place the print head assemblies over a distance relative to the substrate edge registering means; means for coupling the print head assemblies to the motor controller assemblies for moving the print head assemblies relative to each other in a moving direction substantially parallel to the width of the substrate; auto-sensing means for determining a dimension of the substrate as the substrate is fed into the printer; and a set of pre-determined criteria by which the microprocessor-based controller determines the print position for each of the print head assemblies.

Preferably, the in-line printer further comprises a fence for guiding the substrate along the feedpath wherein the fence is capable of adjusting a width of the feedpath according to the width of the substrate, and encoder means coupled to the adjustable substrate material fence for determining a position of the adjustable substrate material fence as the fence moves over a distance relative to the substrate edge registering means whereby the width of the substrate corresponds to the distance between the substrate edge registering means and the fence.

Further, a preferred embodiment of the in-line printer further comprises a fixed wall at one side of the substrate feed path substantially opposite the other side of the width of the feed path defined by the position of the adjustable substrate material fence for registering the edge of the substrate. The in-line printer further comprises a plurality of guide rails oriented in a direction substantially parallel to the width of the substrate for slidably mounting the print head assemblies so as to allow the print head assemblies to move relative to each other along the moving direction. Additionally, the in-line printer comprises at least one guide rail oriented in a direction substantially parallel to the width of the substrate for slidably mounting the adjustable substrate material fence so as to allow the fence to move toward and away from the fixed wall.

Preferably, each of the print head assemblies has a home position located on one side of the in-line printer remotely from the printing position across the width of the substrate.

A second aspect of the present invention is a method of in-line printing for printing on a substrate material within a plurality of printing bands, wherein the printing bands are distributed in a predetermined manner over the width of the substrate. The method comprises several steps which include: registering one edge of the substrate; feeding the substrate material from a feed area into a print area along a feed direction substantially perpendicular to the width; and providing a plurality of automatic, positional print heads assemblies in the print area, each assembly including at least one print head. Additionally, the steps comprise: determining a print position for each one of the print heads; and directing each one of the print head assemblies, via one or more motor controller assemblies, to its associated print position in order to simultaneously place the print head assemblies over a distance relative to the substrate edge registering means. The method additionally comprises moving the print head assemblies relative to each other in a moving direction substantially perpendicular to the feed direction in order to place the print head assemblies over the printing bands; determining a dimension of the substrate, via auto-sensing means, as the substrate is fed into the printer; and providing a set of pre-determined criteria by which the microprocessor-based controller means determines the print position for each of the print head assemblies.

These and other objects and features of the present invention will become more apparent from an understanding of the following detailed description of the preferred embodiment of the present invention when considered in conjunction with the accompanying drawings.

DETAILED DESCRIPTION

Figure 1:
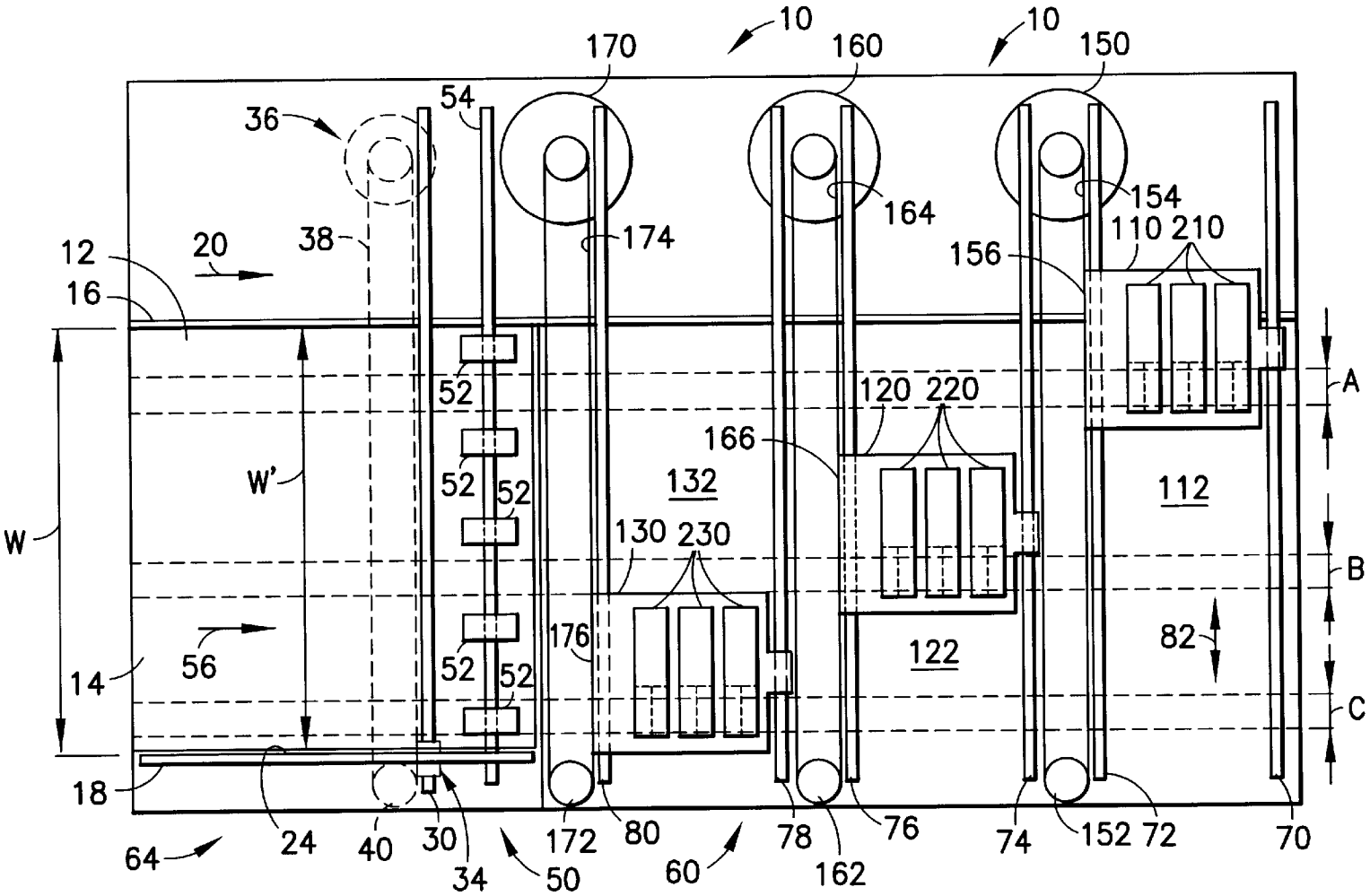
FIG. 1 is a diagrammatic representation illustrating an in-line printer having automatic positioning multiple microprocessor controlled print head assemblies embodying the present invention for placing the print head assemblies for printing on a large substrate.

Turning now to the drawings and considering the present invention in further detail, an in-line printer having automatic positioning multiple microprocessor controlled print head assemblies for placing the print head assemblies for printing on substrates is shown in diagrammatic representations in FIGS. 1–5 and is designated generally 10. In the drawings, like reference numerals refer to like parts, wherein the in-line printer 10 includes a material feed bin area, generally designated 12, for holding the substrate or printing medium to be fed to the printer for printing, and which substrate material is generally designated 14 in FIG. 1. The substrate material 14 may be mail pieces such as, envelopes of various sizes, large flat envelopes, or other printing medium as required. The bin 12 includes a fixed wall 16 which is used for registration of one edge of the substrate material as will become apparent from the description below.

A plurality of print heads are used for printing indicia, the return address, the destination address or barcode, optional message line or other text and graphics as required. To properly orient and position an assembly of print heads for printing in the desired designated print areas of the substrate material, it is necessary to know the size and configuration of the substrate material to be printed upon. This identification process is accomplished in the present invention by first determining the width or length dimension of the substrate material as it is fed into the printer and then selecting from a set of predetermined criteria which is preprogrammed and stored in a memory for retrieval by a microprocessor in response to the detection and determination of the sensed dimension. The print heads typically ink jet print heads carried by the print head assemblies, are controlled by the microprocessor to print or not print in accordance with the information to be applied to each of the different print areas. Each of the print areas are defined by the preprogrammed information for each of the possible predetermined criteria corresponding to the possible number of different dimensional substrate material configurations contemplated to be fed and printed upon.

An adjustable substrate material fence 18 is movable in a direction transverse to the substrate material feed direction shown by direction arrow 20. The adjustable substrate material fence 18 is slidably mounted via a slide assembly 34 on a guide rail 30 for movement into contact with the edge of the substrate material at the fence end 24 opposite the fixed wall 16. The substrate material 14 to be fed and printed upon is stacked and held between the fixed wall 16 and the adjustable substrate material fence 18. The adjustable substrate material fence 18 is movable transverse to the feed direction 20 of the substrate material 14 being fed to the printer 10 to accommodate different sized substrate material as illustrated by the position of the adjustable fence shown in FIG. 2 for example.

An encoder assembly generally designated 36 is located at one side of the material feed area and includes a continuous loop or belt 38 which spans the material feed area and around an idler wheel 40. The belt 38 is attached to the adjustable fence 18 via the slide assembly 34 and moves with the fence 18. The encoder 36 may be of various types known to those in the encoder art and may include optical, mechanical, magnetic or other technologies used to perform the encoder function. The encoder 36 is "zeroed" when the adjustable fence 18 is moved its furthest distance toward the fixed wall 16. When the adjustable fence 18 is moved away from the fixed wall, the distance between the fixed wall 16 and the position of the fence 18 is determined by a software algorithm based on the revolutions of the encoder driven by the belt 38. Thus the width of a substrate is determined by moving the adjustable fence 18 into contact with one edge of the substrate opposite the edge in contact with the fixed wall 16.

A substrate material feed roller assembly, generally designated 50, feeds the substrate material 14 one at a time, in accordance with any of a number of ways well known to those in the substrate feeding art, into a print head area generally designated 60. The in-line printer 10 preferably has means for accessing the print head assemblies for maintenance and/or replacement of the ink cartridges, calibration, home position adjustment, etc. It will be understood that the in-line printer 10 illustrated in FIGS. 1–5 is generically representative of one type of in-line printer machine that may be used with the present invention.

A diagrammatic representation of a top view of a feeding/printing area is illustrated in FIGS. 1–5 and generally designated 62. The feeding/printing area 62 includes a material feed area generally designated 64 that cooperates with the material bin 12 where the substrate material 14 or medium to be fed and printed upon is stacked for feeding to the in-line printer. As shown, the adjustable material fence 18 can be slidably moved along the guide rail 30 closer to the fixed wall 16 or away from the fixed wall 16 to accommodate the different widths W' of the substrate material 14. The fixed wall 16 is used to register one edge of the substrate material. The substrate material feed roller assembly 50 includes a number of spaced-apart feed rollers 52 which are mounted on a roller drive shaft 54 mounted transverse to the direction of substrate material feed direction 20. The roller drive shaft 54 can be rotated by a gear belt or other drive means well known to those skilled in the art of substrate material feed assemblies. The material feed roller assembly 50 is driven in a timed manner to feed the substrate material 14 along a feed path 56 into the print head area 60 to and past one or more print zones each having one print head assembly and wherein each print head assembly has at least one print head. The print head area 60 includes a transport surface (not shown) for moving the substrate into, through and from the print head area. The transport surface may be belts, drums, rollers or other transport mechanisms well known to those in the art of substrate movement and transport.

As shown in FIGS. 1–5, print head assemblies 110, 120 and 130 are, located respectively, in print zones 112, 122 and 132. The print head assembly 110 has three print heads 210 capable of printing on a swath or band A. Likewise, the print head assembly 120 has three print heads 220, capable of printing on a swath or band B, and the print head assembly 130 has three print heads 230, capable of printing on swath or band C. A plurality of guide rails 70, 72, 74, 76, 78 and 80 are used to slidably mount the print head assemblies 110, 120 and 130, allowing some or all of these print head assemblies to move along a rectilinear path in a direction 82 which is substantially perpendicular to the feed direction 20.

Each of the print head assemblies 110, 120 and 130 attaches to a drive belt 154, 164 and 174, respectively at corresponding attachment points 156, 166 and 176. The drive belt 154 extends across the width of the print head area 60 transverse to the direction of movement of the substrate from a drive motor 150 and around an idler wheel 152. The drive motor 150 includes an encoder for incrementally moving and positioning the print head assembly 110 at a desired position relative to the print zone 112 across the width of the print head area. The print head assembly 110 has a home position, which for purposes of this disclosure is designated generally as 90, and together with the home position, the control software directs movement and position of the print head assembly via the drive motor 150. The drive belt 164 extends across the width of the print head area 60 transverse to the direction of movement of the substrate from a drive motor 160 and around an idler wheel 162. The drive motor 160 includes an encoder for incrementally moving and positioning the print head assembly 120 at a desired position relative to the print zone 122 across the width of the print head area. The print head assembly 120 has a home position, which for purposes of this disclosure is designated generally as 92, and together with the home position, the control software directs movement and position of the print head assembly via the drive motor 160. The drive belt 174 extends across the width of the print head area 60 transverse to the direction of movement of the substrate from a drive motor 170 and around an idler wheel 172. The drive motor 170 includes an encoder for incrementally moving and positioning the print head assembly 130 at a desired position relative to the print zone 132 across the width of the print head area. The print head assembly 130 has a home position, which for purposes of this disclosure is designated generally as 94, and together with the home position, the control software directs movement and position of the print head assembly via the drive motor 170.

FIG. 1 illustrates the placement of the print head assemblies 110, 120,and 130 when a large substrate 14 is fed through the feed path 56 for printing. As shown, the substrate material fence 18 has been moved toward the fixed wall 16 so that the width W of the feed path 56 is substantially equal to the width W' of the substrate 14. In this case, the print head assemblies 110, 120 and 130 are directed from their respective home positions 90, 92 and 94 so that the print swaths or bands A, B and C are properly spaced relative to one another and evenly cover the width W' of the substrate 14 when the substrate is in position for printing in the feeding/printing area 62. In FIG. 1, the width W' of the substrate is about 10 inches (25.4 cm.), for example.

Figure 2:
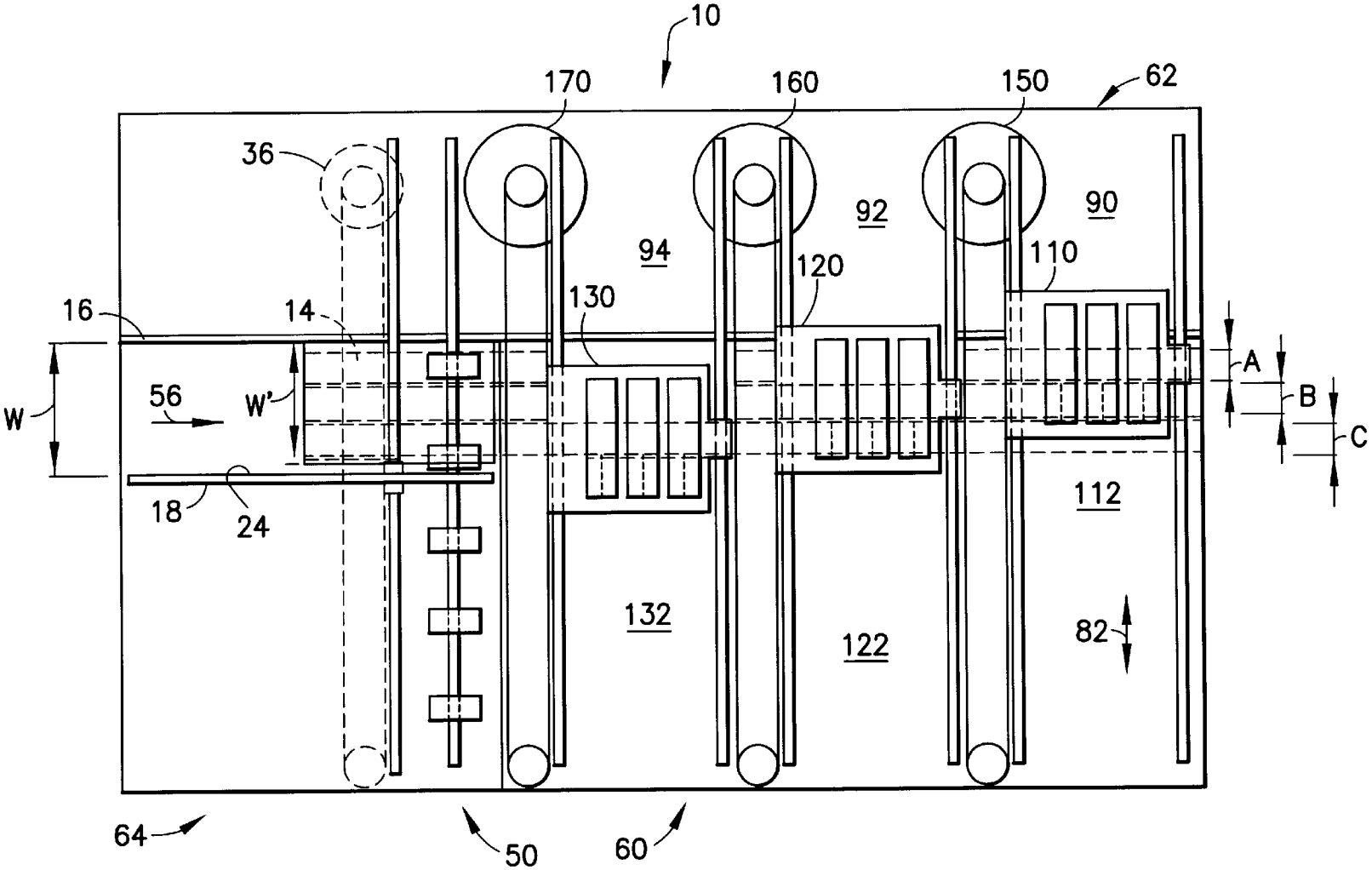
FIG. 2 is a diagrammatic representation illustrating an in-line printer having automatic positioning multiple microprocessor controlled print head assemblies embodying the present invention for placing the print head assemblies for printing on a small substrate.

FIG. 2 illustrates the placement of the print head assemblies 110, 120,and 130 when a small substrate 14 is fed through the feed path 56 for printing. As shown, the substrate material fence 18 has been moved toward the fixed wall 16 so that the width W of the feed path 56 is substantially equal to the width W' of the substrate 14. In this case, the print head assemblies 110, 120 and 130 are directed from their respective home positions 90, 92 and 94 so that the print swaths or bands A, B and C are properly spaced relative to one another and evenly cover the width W' of the substrate 14 when the substrate is in position for printing in the feeding/printing area 62. In FIG. 2, the width W' of the substrate is about 3 inches (7.62 cm.), for example.

For purposes of this disclosure, the substrate material 14 is illustrated with a fixed print area or band generally designated as swath A in which typically the return address or other indicia information is printed. A second print area or band, generally designated as swath B, contains the destination address and destination barcode if one is so used. A third or bottom print area or band, generally designated as swath C, contains a message line or optional barcode if one is so used. The location of the three print areas or bands are predetermined and set in accordance with the standards set by the United States Postal Service.

Figure 3:
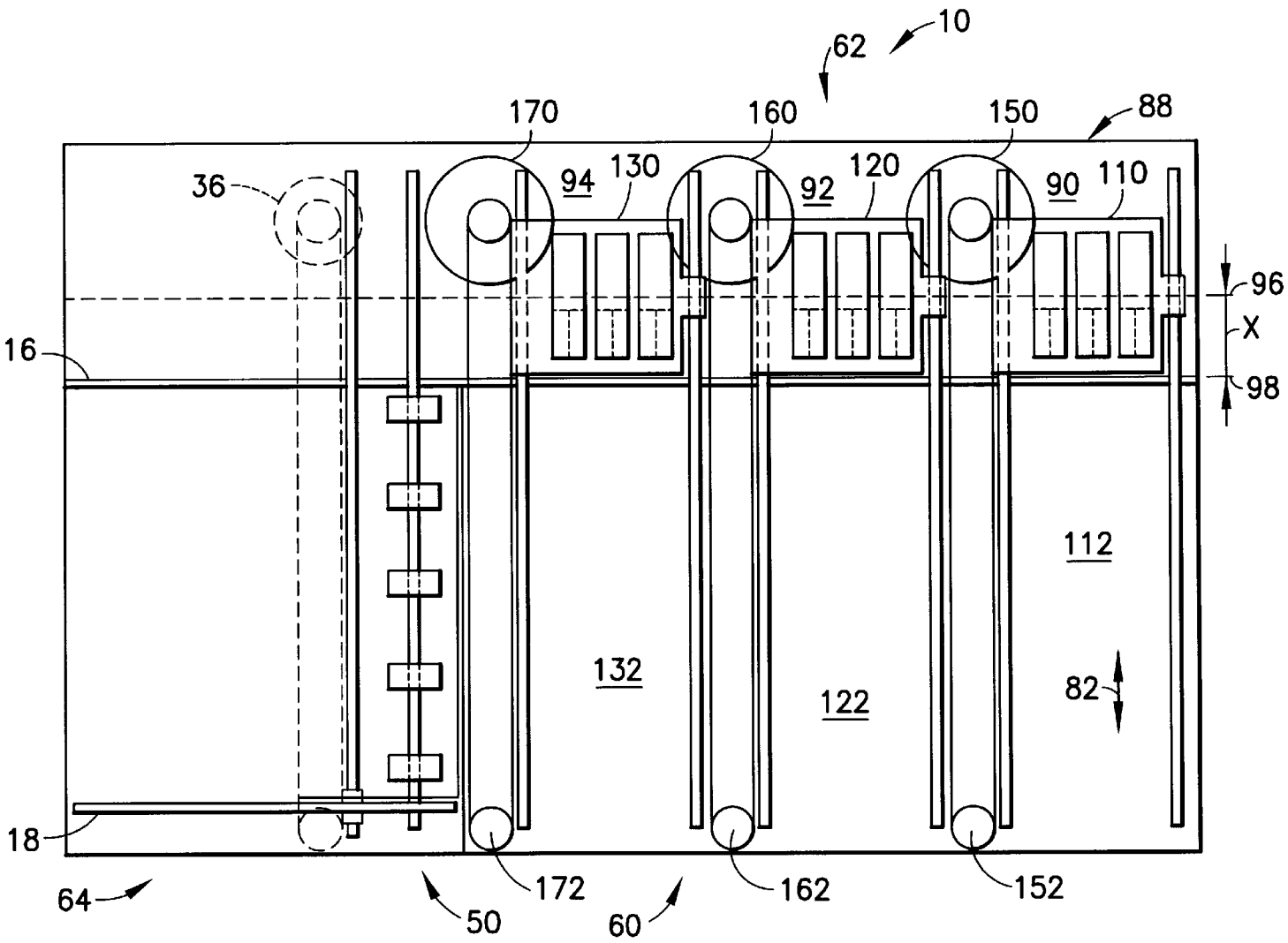
FIG. 3 is a diagrammatic representation illustrating the in-line printer of FIG. 1 showing the automatic positioning multiple microprocessor controlled print head assemblies in the home position.

FIG. 3 illustrates the print head assemblies 110, 120 and 130 located in their home position at one side 88 of the in-line printer 10 and generally along the center home line 96 passing through the longitudinal center of the print head assemblies. When moved into the home position, the print head assemblies 110, 120 and 130 are withdrawn from the feeding/printing area 62 a distance X with reference to a line 98 that is coincident with the fixed wall 16. Although FIG. 3 illustrates all of the print head assemblies 110, 120 and 130 withdrawn to the home position at the same time, the software control program can move any of the print head assemblies to the home position independent of the position of the others of the print head assemblies. The home position is utilized for maintenance purposes associated with the print head assemblies, drive motors, calibration or replacement of the ink cartridges as required.

Figure 4:
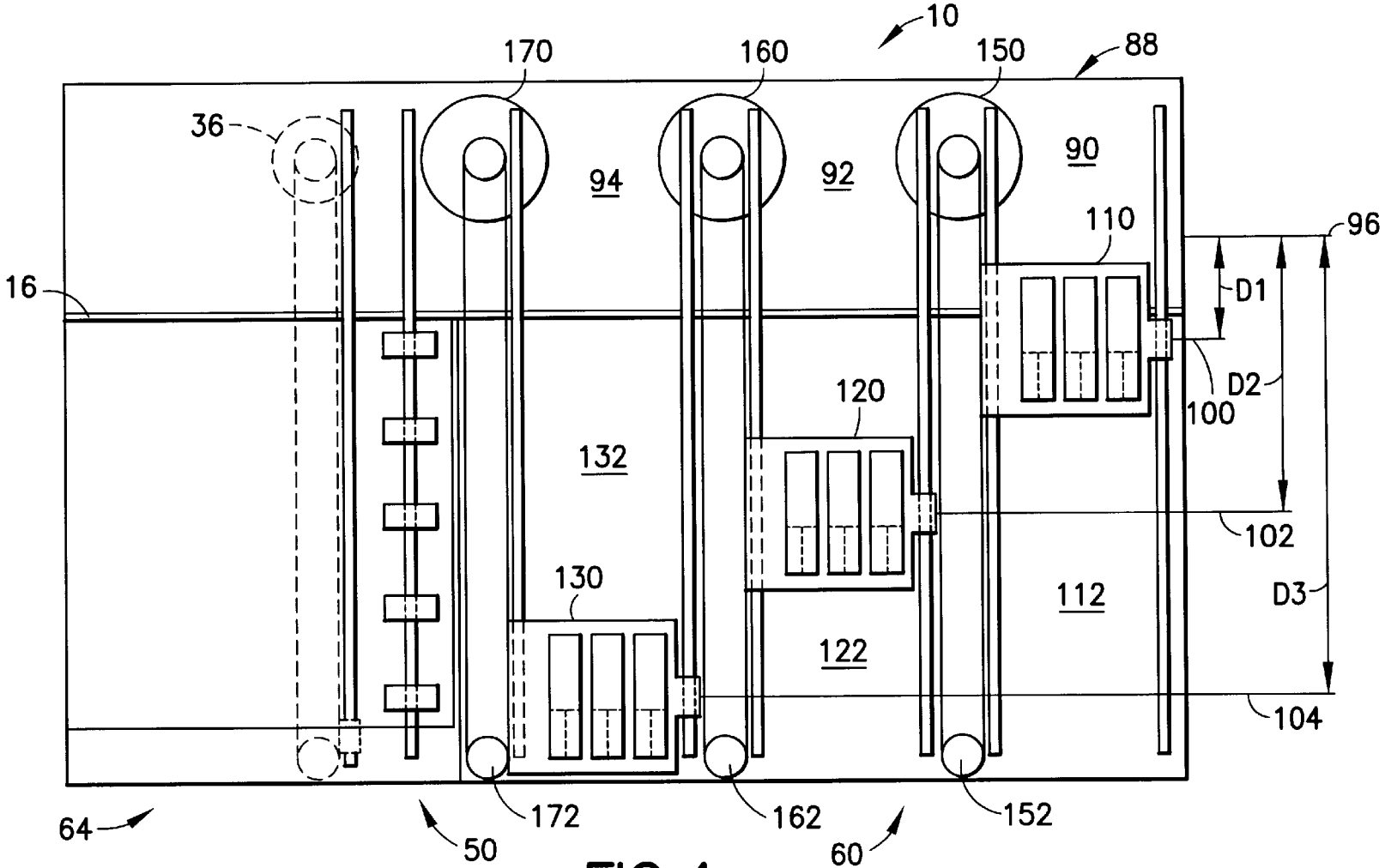
FIG. 4 is a diagrammatic representation illustrating the in-line printer of FIG. 1 showing the extent of travel of the automatic positioning multiple microprocessor controlled print head assemblies across the substrate transport surface.
Figure 5:
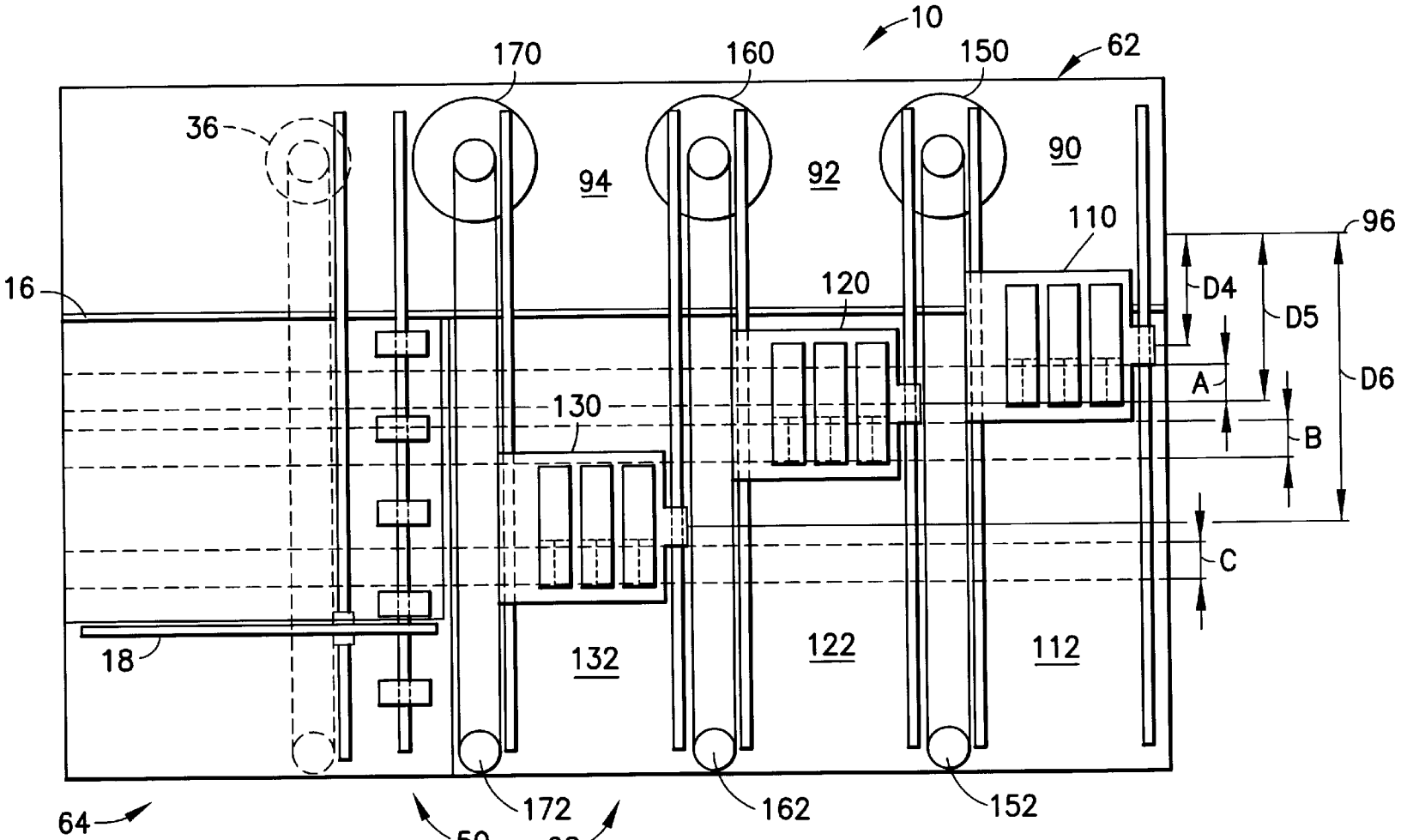
FIG. 5 is a diagrammatic representation illustrating the in-line printer of FIG. 1 showing the automatic positioning multiple microprocessor controlled print head assemblies placed for custom printing on a large substrate.

FIG. 4 illustrates the allowed travel distances for the print head assemblies 110, 120 and 130 from their respective home position with reference to the center home line 96. Print head assembly 110 travels a distance D1 from its home position, print head assembly 120 travels a distance D2 from its home position and print head assembly 130 travels a distance D3 from its home position. Although the print head assemblies can travel the full distance across the feeding/printing area 62, it is desirable to limit the maximum travel distance to cover only those print swaths or bands that the print head assemblies will print in across the surface of a substrate to be printed upon. The travel distances are adjustable and controlled by the printer control software program.

As can be appreciated by those skilled in the printer art, a number of variations of the subject invention are possible. These variations include, but are not limited to, the use of photo-optic sensors to detect the adjustable material fence in its position nearest the substrate edge registration wall to "zero" the encoder 36, or sense the print head assemblies at the home position.

It is to be understood that the present invention is not to be considered as limited to the specific embodiments described above and shown in the accompanying drawings, which merely illustrate the best mode presently contemplated for carrying out the invention and which is susceptible to such changes as may be obvious to one skilled in the printing art, but rather that the invention is intended to cover all such variations, modifications and equivalents thereof as may be deemed to be within the scope of the claims appended hereto.

What is claimed is:

1. An in-line printer for printing on a substrate, comprising:

(a) means for registering one edge of the substrate;

(b) a plurality of automatic, positional print head assemblies, each assembly including at least one print head;

(c) a microprocessor-based controller for determining a print position for each one of said print head assemblies;

(d) a first moving mechanism capable of moving the substrate towards the print head assemblies along a feed path in a feed direction substantially perpendicular to the width of the substrate;

(e) one or more motor controller assemblies for directing said each one of said print head assemblies to associated print position in order to simultaneously place the print head assemblies over a distance relative to the substrate edge registering means;

(f) coupling means for coupling said print head assemblies to said motor controller assemblies for moving the print head assemblies relative to each other in a moving direction substantially parallel to the width of the substrate;

(g) auto-sensing means for determining a dimension of said substrate as said substrate is fed into said printer; and (h) a set of pre-determined criteria by which said microprocessor-based controller determines said print position for each of said print head assemblies.

2. An in-line printer as defined in claim 1 wherein said auto-sensing means further comprises:

(a) a fence for guiding the substrate along the feedpath wherein said fence is capable of adjusting a width of the feedpath according to the width of the substrate, and (b) encoder means coupled to said adjustable substrate material fence for determining a position of said adjustable substrate material fence as said fence moves over a distance relative to said substrate edge registering means whereby the width of the substrate corresponds to the distance between the substrate edge registering means and the fence.

3. An in-line printer as defined in claim 2 wherein said microprocessor based controller further comprises means for calculating the dimension of the substrate whereby the substrate is printed on in accordance with said predetermined criteria corresponding to said dimension of the substrate.

4. An in-line printer as defined in claim 1 wherein the substrate edge registering means further comprises a fixed wall at one side of the substrate feed path substantially opposite the other side of the width of the feed path defined by the position of the adjustable substrate material fence.

5. An in-line printer as defined in claim 1, further comprising a plurality of guide rails oriented in a direction substantially parallel to the width of the substrate for slidably mounting the print head assemblies so as to allow the print head assemblies to move relative to each other along the moving direction.

6. An in-line printer as defined in claim 1 further comprising at least one guide rail oriented in a direction substantially parallel to the width of the substrate for slidably mounting the adjustable substrate material fence so as to allow the fence to move toward and away from the fixed wall.

7. An in-line printer as defined in claim 1 wherein said plurality of automatic, positional print head assemblies have home positions, respectively on one side of the printer.

8. An in-line printer as defined in claim 7 wherein each of said print head assemblies are movable to its home position independent of the position of the others of said print head assemblies.

9. An in-line printer as defined in claim 1 wherein each one of said plurality of automatic, positional print head assemblies has a home position on one side of the printer.

10. A method for printing on a substrate material within a plurality of printing bands, wherein the printing bands are distributed in a predetermined manner over the width of the substrate, said method comprising the steps of:

(a) registering one edge of the substrate;

(b) feeding the substrate material from a feed area into a print area along a feed direction substantially perpendicular to the width;

(c) providing a plurality of automatic, positional print head assemblies in the print area, each assembly including at least one print head;

(d) determining a print position, utilizing microprocessor-based controller means, for each one of said print head assemblies;

(e) directing said each one of said print head assemblies to associated print position, via one or more motor controller assemblies, in order to simultaneously place the print head assemblies over a distance relative to the substrate edge registering means;

(f) moving the print head assemblies relative to each other in a moving direction substantially perpendicular to the feed direction in order to place the print head assemblies over the printing bands;

(g) determining a dimension of said substrate via auto-sensing means as said substrate is fed into said printer; and (h) providing a set of pre-determined criteria by which said microprocessor-based controller means determines said print position for each of said print head assemblies.

* * * * *